US012583705B2

(12) United States Patent
Shiina

(10) Patent No.: US 12,583,705 B2
(45) Date of Patent: Mar. 24, 2026

(54) MEDIUM LOADING DEVICE

(71) Applicant: RISO KAGAKU CORPORATION, Tokyo (JP)

(72) Inventor: Kensuke Shiina, Tokyo (JP)

(73) Assignee: RISO KAGAKU CORPORATION, Tokyo (JP)

( * ) Notice: Subject to any disclaimer, the term of this patent is extended or adjusted under 35 U.S.C. 154(b) by 84 days.

(21) Appl. No.: 18/626,370

(22) Filed: Apr. 4, 2024

(65) Prior Publication Data

US 2024/0343520 A1 Oct. 17, 2024

(30) Foreign Application Priority Data

Apr. 17, 2023 (JP) ..... 2023-067182

(51) Int. Cl.
*B65H 31/38* (2006.01)
*B65H 43/04* (2006.01)

(52) U.S. Cl.
CPC ..... *B65H 31/38* (2013.01); *B65H 43/04* (2013.01); *B65H 2405/15* (2013.01)

(58) Field of Classification Search
CPC ..... B65H 31/38; B65H 43/04
See application file for complete search history.

(56) References Cited

U.S. PATENT DOCUMENTS

| | | | | |
|---|---|---|---|---|
| 8,899,580 | B2 * | 12/2014 | Liu | B65H 9/004 271/223 |
| 10,065,829 | B2 * | 9/2018 | Nakayama | B65H 31/38 |
| 11,148,898 | B2 * | 10/2021 | Eden | B65H 9/101 |
| 11,731,850 | B2 * | 8/2023 | Christiansen | B65H 1/30 271/3.02 |
| 2024/0034589 | A1 * | 2/2024 | Morita | B65H 31/34 |
| 2024/0279018 | A1 * | 8/2024 | Kotaka | B65H 43/00 |

FOREIGN PATENT DOCUMENTS

| | | | | |
|---|---|---|---|---|
| DE | 102007052319 | A1 * | 5/2009 | B65H 31/34 |
| JP | 61033464 | A * | 2/1986 | |
| JP | 2021-80091 | A | 5/2021 | |

* cited by examiner

*Primary Examiner* — Patrick Cicchino
(74) *Attorney, Agent, or Firm* — Greenblum & Bernstein, P.L.C.

(57) ABSTRACT

According to an aspect, a medium loading device includes a loading table on which a medium is loaded, a fence in contact with an end of the medium loaded on the loading table, and a processor configured to vibrate the fence when leaning of the medium against the fence is detected.

6 Claims, 5 Drawing Sheets

MEDIUM LOADING DEVICE

CROSS-REFERENCE TO RELATED APPLICATION

This application is based upon and claims the benefit of priority of the prior Japanese Patent Application No. 2023-067182 filed on Apr. 17, 2023, the entire contents of which are incorporated herein by reference.

FIELD

Embodiments discussed herein are related to a medium loading device on which a medium is loaded.

BACKGROUND

Conventionally, there has been proposed a medium ejection device that performs control to stop the ejection (printing) of a medium, move a movable fence from the restriction position to the retreat position and return the movable fence to the restriction position, and then resume the ejection of the medium when it is detected that the medium is leaning against the movable fence (see, for example, JP 2021-080091 A).

SUMMARY

According to an aspect, a medium loading device includes a loading table on which a medium is loaded, a fence in contact with an end of the medium loaded on the loading table, and a processor configured to vibrate the fence when leaning of the medium against the fence is detected.

An object and advantages of the invention will be realized and attained by means of the elements and combinations particularly pointed out in the claims.

DETAILED DESCRIPTION

In particular, in a large-capacity paper ejection unit of a printing apparatus capable of printing a large number of sheets at high speed, there is a case where paper leans against the end fence on the downstream side in the transport direction or the top fence on the upstream side in the transport direction during printing. When such leaning occurs, a leaning sensor detects the leaning to stop the printing, and the user corrects the leaning and resumes the printing. This puts a burden on the user to increase the downtime of the apparatus.

In addition, when the apparatus is stopped due to the leaning and the user tries to cope with it, the leaning may be naturally eliminated, which leads to a decrease in the reliability of the apparatus. In addition, it is known that when the amount of leaning is small, the leaning is naturally eliminated by the passage of time, contact with the next paper, vibration of the paper ejection table, and the like.

As described above, in the medium ejection device that stops the ejection (printing) of a medium and moves the movable fence from the restriction position to the retreat position when the leaning is detected, it takes time to move the movable fence. For this reason, downtime occurs.

Hereinafter, a medium loading device according to an embodiment of the invention will be described with reference to the diagrams.

Figure 1:
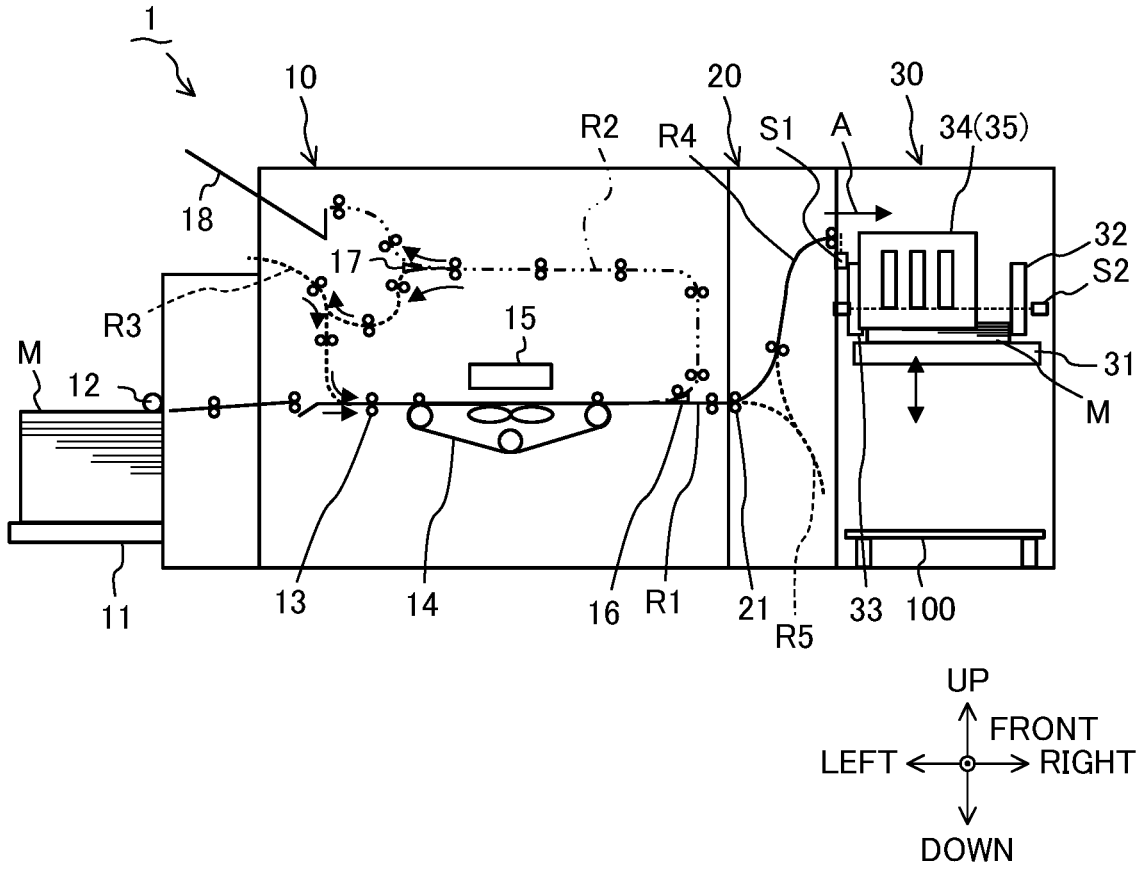
FIG. 1 is a diagram illustrating the internal configuration of a printing system including a medium loading device according to an embodiment.

FIG. 1 is a diagram illustrating the internal configuration of a printing system 1 including a medium loading device 30 according to an embodiment.

Figure 2:
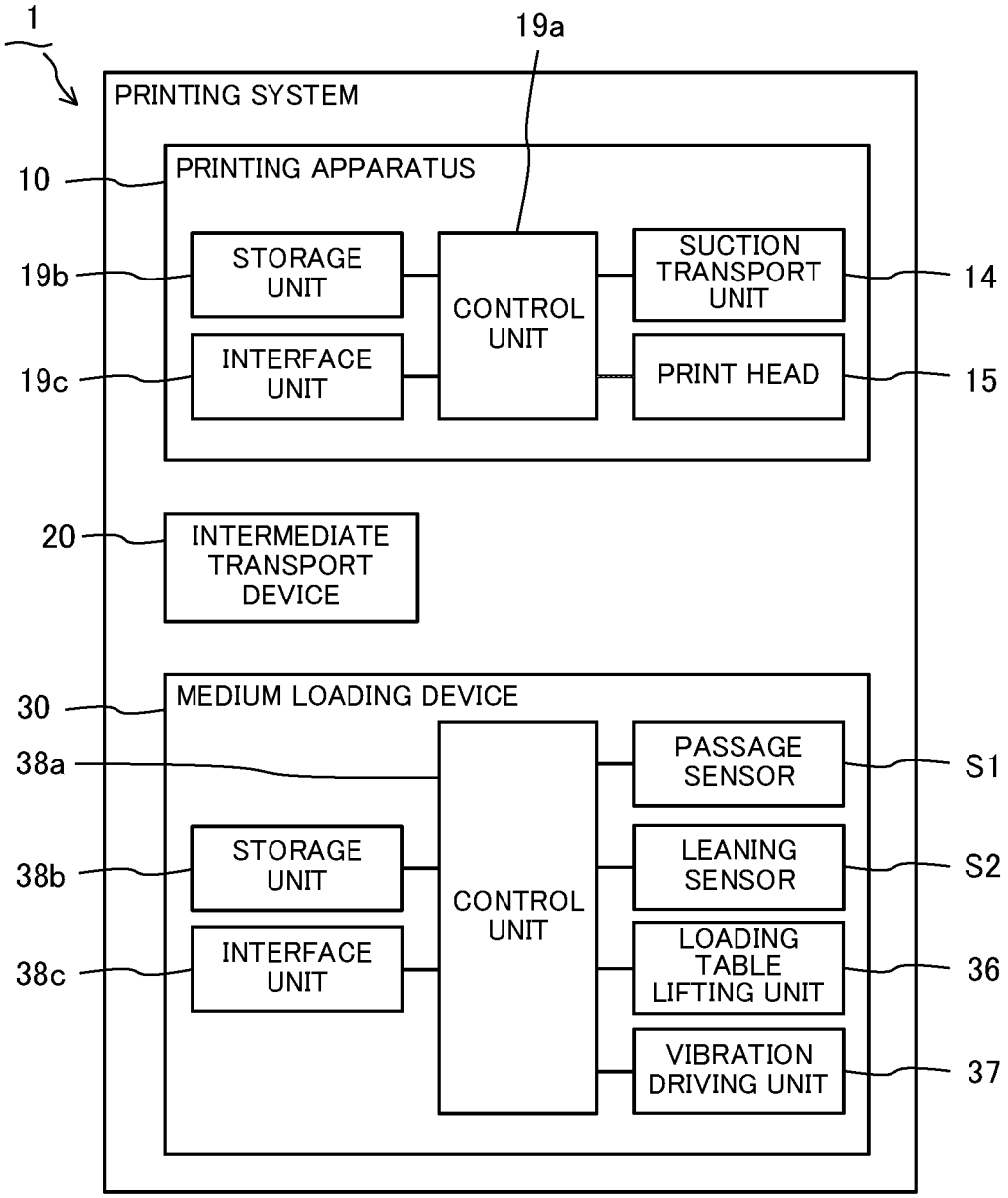
FIG. 2 is a diagram illustrating the main control configuration of the printing system including the medium loading device according to the embodiment.

FIG. 2 is a diagram illustrating the main control configuration of the printing system 1.

The printing system 1 illustrated in FIGS. 1 and 2 includes a printing apparatus 10, an intermediate transport device 20, and the medium loading device 30.

In addition, up-down, front-back, and left-right directions illustrated in FIG. 1 and FIGS. 3, 4, and 6 to be described later are examples for convenience of description. For example, the up-down direction is a vertical direction, and the front-back direction and the left-right direction are horizontal directions. In addition, in FIG. 1, a straight transport path R1 of a medium M in the printing apparatus 10 and an ejection path R4 of the medium M in the intermediate transport device 20 are indicated by solid lines. In addition, in FIG. 1, a circulating transport path R2 of the medium M in the printing apparatus 10 is indicated by a two-dot chain line, and reverse transport paths R3 and R5 in the printing apparatus 10 and the intermediate transport device 20 are indicated by broken lines. As an example, the medium M is a sheet-like medium such as a sheet of paper (paper).

As shown in FIG. 1, the printing apparatus 10 includes a medium supply unit 11, a feed roller 12, a plurality of transport roller pairs 13, a suction transport unit 14, a print head 15, transport path switching units 16 and 17, and a loading table 18. In addition, as shown in FIG. 2, the printing apparatus 10 includes a control unit 19*a*, a storage unit 19*b*, and an interface unit 19*c*. In addition, the printing system 1 includes a single printing apparatus 10, but may include, for example, a plurality of printing apparatuses arranged in series on the transport path of the medium M.

The medium M is loaded on the medium supply unit 11. The medium supply unit 11 is arranged integrally with the printing apparatus 10, but may be arranged separately from the printing apparatus 10. The feed roller 12 feeds out and transports the topmost medium M among the plurality of media M loaded on the medium supply unit 11. A plurality of transport roller pairs 13 are arranged in each of the straight transport path R1, the circulating transport path R2, and the reverse transport path R3 in the printing apparatus 10, and transport the medium M while nipping the medium M. The suction transport unit 14 is arranged so as to face the print head 15. The suction transport unit 14 transports the medium M using, for example, a belt while sucking the medium M. In addition, the feed roller 12, the plurality of transport roller pairs 13, the suction transport unit 14, and a plurality of transport roller pairs 21 of the intermediate transport device 20 to be described later are examples of a transport unit that transports the medium M.

The print head 15 includes, for example, a line head type inkjet head (not illustrated) for each color used for printing. In addition, the printing method of the print head 15 may be a printing method other than the inkjet printing method. That is, the print head 15 is merely an example of a printing unit that performs printing on the medium M, and the printing unit is not limited to the inkjet printing type print head 15.

The transport path switching unit 16 is, for example, a flapper, and switches the transport path of the medium M on which printing is performed by the print head 15 between the straight transport path R1 continuing to the intermediate transport device 20 and the circulating transport path R2 continuing to the loading table 18 or the reverse transport path R3. The transport path switching unit 17 is, for example, a flapper, and switches the circulating transport path R2 of the medium M between a transport path continuing to the loading table 18 and a transport path continuing to the reverse transport path R3. The medium M that is not ejected to the medium loading device 30 is loaded on the loading table 18. In addition, the front and back sides of the medium M are reversed in the reverse transport path R3, and the medium M is transported to the print head 15 again so that printing is performed on the opposite side.

The control unit 19*a* illustrated in FIG. 2 includes one or more processors (for example, a central processing unit (CPU)) functioning as an arithmetic processing device that controls the operation of the entire printing apparatus 10. The processor controls the operation of each unit of the printing apparatus 10 by reading and executing a predetermined program from, for example, the storage unit 19*b* or a storage medium (non-transitory computer-readable recording medium) detachable from the printing apparatus 10. In this manner, the control unit 19*a* (or the printing apparatus 10) functions as an example of a computer that executes a program. The control unit 19*a* may control a plurality of transport roller pairs 21 of the intermediate transport device 20 to be described later. Note that the control unit 19*a* of the printing apparatus 10 may function as a control unit 38*a* of the medium loading device 30 to be described later. In addition, a control unit serving as both the control unit 19*a* of the printing apparatus 10 and the control unit 38*a* of the medium loading device 30 may be arranged outside the printing apparatus 10.

The storage unit 19*b* includes, for example, a memory such as a read only memory (ROM), which is a read-only semiconductor memory in which a predetermined control program is recorded in advance, and a random access memory (RAM), which is a semiconductor memory that can be written and read at any time and is used as a working storage area as necessary when the processor executes various control programs.

The interface unit 19*c* transmits and receives various kinds of information to and from devices, such as the medium loading device 30 and a user terminal. For example, the interface unit 19*c* transmits the medium information to the medium loading device 30 based on a print job, a detection result of a sensor (not illustrated) arranged in the medium supply unit 11 or the like, settings of the printing apparatus 10, and the like. The medium information includes, for example, the size, orientation, type (for example, thickness, basis weight, material, and the like), the transport speed (ejection speed in the medium loading device 30), and the positional deviation (for example, a setting position in the medium supply unit 11, a deviation in the width direction during transport, and the like) on the upstream side in a transport direction A of the medium M.

As illustrated in FIG. 1, the intermediate transport device 20 includes a plurality of transport roller pairs 21. The plurality of transport roller pairs 21 transport the medium M ejected from the printing apparatus 10 while nipping the medium M.

The medium loading device 30 includes a loading table 31, an end fence 32, a top fence 33, side fences 34 and 35, a passage sensor S1, and a leaning sensor S2. In addition, as illustrated in FIG. 2, the medium loading device 30 includes a loading table lifting unit 36, a vibration driving unit 37, a control unit 38*a*, a storage unit 38*b*, and an interface unit 38*c*.

The medium loading device 30 is arranged separately from the printing apparatus 10, but may be arranged integrally with the printing apparatus 10. That is, the medium loading device 30 may function as a part of the printing apparatus 10. In addition, the medium loading device 30 may be loaded with the medium M ejected from a processing device that performs processing other than printing on the medium M or a transport device that transports the medium M instead of being loaded with the medium M on which printing has been performed in the printing apparatus 10. In addition, when the intermediate transport device 20 is omitted, the medium M may be directly ejected from the printing apparatus 10 to the medium loading device 30. In addition, in the printing system 1, a plurality of medium loading devices 30 on which the medium M ejected from the printing apparatus 10 is selectively loaded may be arranged.

The medium M ejected from the printing apparatus 10 and transported by the intermediate transport device 20 is loaded on the loading table 31. The loading table 31 is arranged so as to be movable up and down so that the loading surface of the medium M has a constant height by the driving of the loading table lifting unit 36 to be described later. The loading table 31 may be a belt conveyor, a roller conveyor, or the like on which the medium M is loaded, that is, a loading table having a transport unit. In addition, the loading table 31 may be detachably arranged in the medium loading device 30. When the medium M is taken out, the loading table 31 may be lowered onto a carriage 100, placed on the carriage 100, and taken out from the medium loading device 30 together with the medium M. In addition, the loading table 31 may be arranged so as not to be movable up and down.

Figure 3:
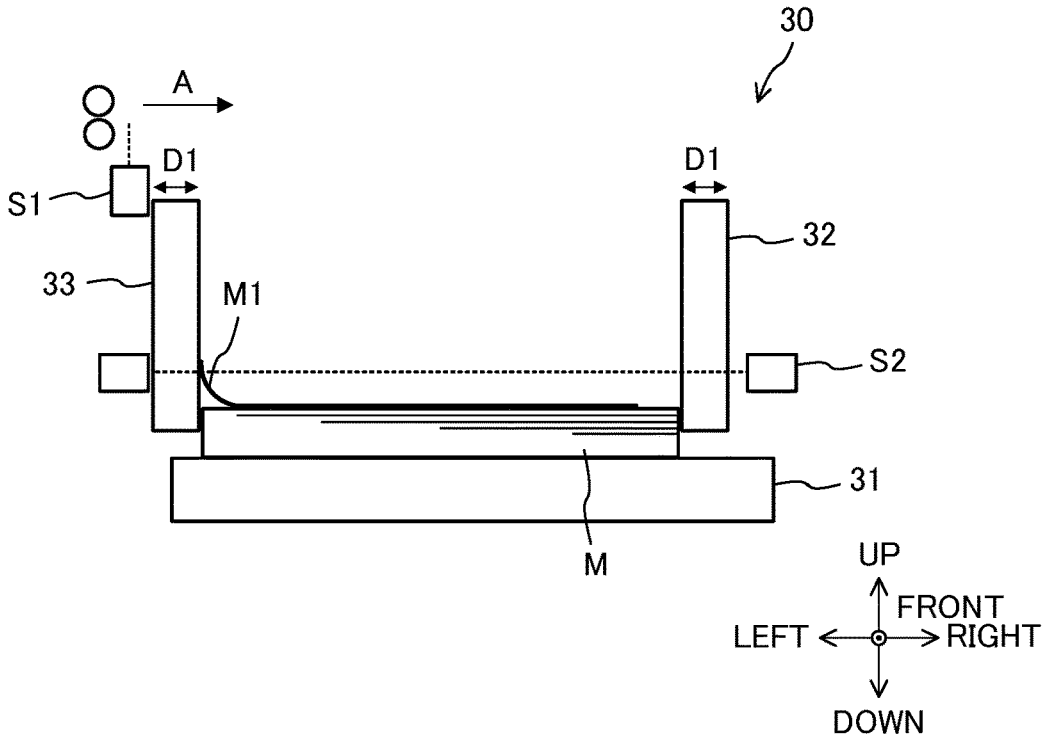
FIG. 3 is a diagram (part 1) for explaining how to eliminate the leaning of a medium in the medium loading device according to the embodiment.
Figure 4:
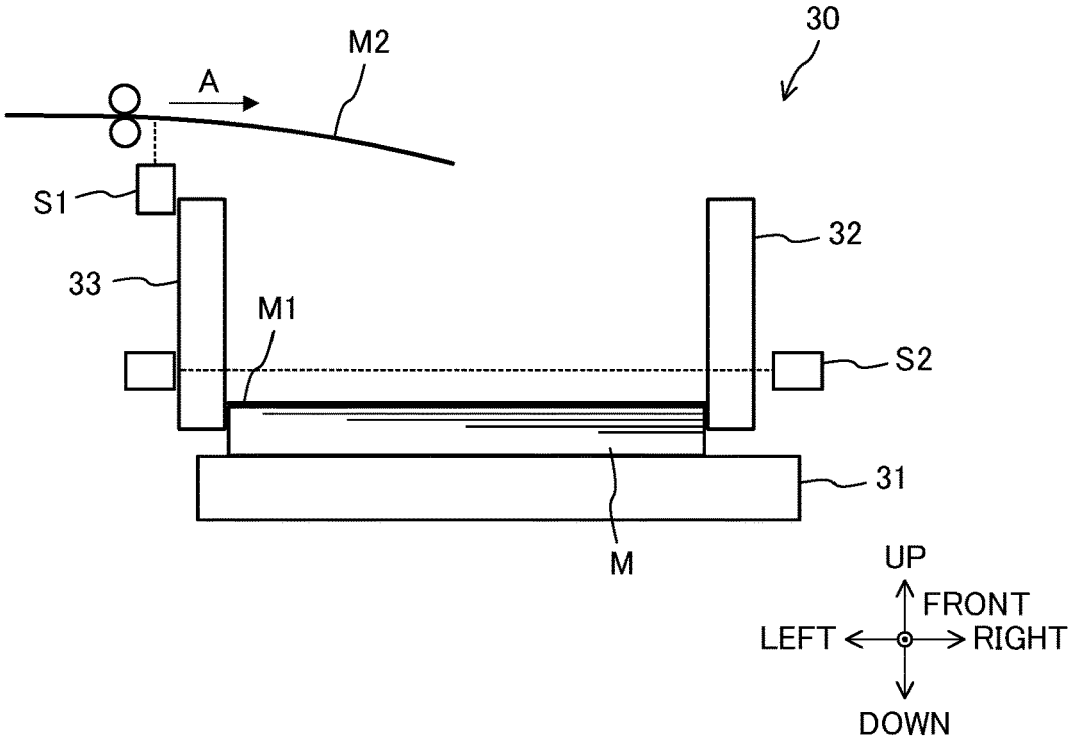
FIG. 4 is a diagram (part 2) for explaining how to eliminate the leaning of a medium in the medium loading device according to the embodiment.

The end fence 32, the top fence 33, and the side fences 34 and 35 are examples of a fence (a regulation unit) in contact with an end (peripheral edge) of the medium M loaded on the loading table 31. In addition, the distance between the end fence 32 and the top fence 33 in the transport direction A is set to a distance slightly larger than the length of the medium M in the transport direction A, and the distance between the side fences 34 and 35 in the width direction (front-back direction in FIG. 1) perpendicular to the transport direction A is set to a distance slightly larger than the length of the medium M in the width direction. However, it can be said that the medium M can come into contact with the end fence 32, the top fence 33, and the side fences 34 and 35 in the process of being ejected (transported) onto the loading table 31. In FIGS. 3 and 4, illustration of the side fences 34 and 35 is omitted.

The end fence 32 is an example of a first regulation member in contact with the end of the medium M on the downstream side (right side in FIG. 3) in the transport direction A. The end fence 32 can also be referred to as an abutment fence because the medium M is abutted against the end fence 32. The top fence 33 is an example of a second regulation member in contact with the end of the medium M on the upstream side in the transport direction A. The side fences 34 and 35 are an example of a third regulation member in contact with the end of the medium M in the width direction perpendicular to the transport direction A.

The end fence 32 and the top fence 33 vibrate in a vibration direction D1 (left-right direction in FIG. 3) parallel to the transport direction A of the medium M by the driving of the vibration driving unit 37 to be described later. The end fence 32 is arranged so as to be movable in the transport direction A according to the size (length in the transport direction A) of the medium M. In addition, the end fence 32 and the top fence 33 may function as an offset guide that offsets the loading position of the medium M forward and backward in the transport direction A by moving forward and backward in the transport direction A at a specified timing such as for each print job, for example.

The passage sensor S1 detects the passage of the medium M transported toward the loading table 31. The passage sensor S1 is, for example, a reflection sensor that emits detection light (illustrated by a dotted line in FIG. 3) upward and detects the presence or absence of the medium M according to whether or not the reflected light reflected by the medium M is received. Alternatively, the passage sensor S1 may be a transmission sensor or the like that includes a light emitting unit and a light receiving unit arranged with the transport path of the medium M interposed therebetween and detects the presence or absence of the medium M according to whether or not the light receiving unit receives the detection light emitted from the light emitting unit.

The leaning sensor S2 is, for example, a transmission sensor that detects the leaning of the medium M against the end fence 32 or the top fence 33 according to whether or not the light receiving unit receives the detection light emitted from the light emitting unit that horizontally emits the detection light (illustrated by a dotted line) above the loading surface height of the medium M on the loading table 31. The light emitting unit and the light receiving unit of the leaning sensor S2 are arranged on the downstream side of the end fence 32 in the transport direction A and on the upstream side of the top fence 33 in the transport direction A. In addition, a hole (not shown) for transmitting the detection light emitted from the light emitting unit is provided in the end fence 32 and the top fence 33, or is arranged at a position not interfering with the detection light.

Here, even the medium M that does not lean against the end fence 32 or the top fence 33 passes through the position where the detection light of the leaning sensor S2 is blocked in the process of being ejected (transported) onto the loading table 31. Therefore, for example, in a case where a state (output signal: ON) in which the light receiving unit of the leaning sensor S2 does not receive the detection light even if the detection light emitted from the light emitting unit of the leaning sensor S2 is blocked by the medium M is continued for a specified time or more, the control unit 38*a* to be described later may detect the leaning of the medium M against the end fence 32 or the top fence 33. For example, based on the number of passing media M detected by the passage sensor S1 (or the ejection interval of the medium M acquired from the printing apparatus 10) and the lowering amount of the loading table 31 based on the detection result of a loading surface sensor (not illustrated) (or the detection result of a loading surface sensor), the control unit 38*a* may detect the leaning of the medium M against the end fence 32 or the top fence 33, for example, in cases where the lowering amount of the loading table 31 is larger than the lowering amount of the loading table 31 with respect to the number of passing media M acquired from the history in a past constant period. In this case, the leaning sensor S2 can be omitted.

The loading table lifting unit 36 illustrated in FIG. 2 is, for example, an actuator such as a motor. The loading table lifting unit 36 raises and lowers the loading table 31 under the driving control of the control unit 38*a*. In addition, a loading surface sensor (not illustrated) that detects that the height of the loading surface of the medium M on the loading table 31 has reached a predetermined height is arranged in the medium loading device 30. The control unit 38*a* controls the loading table lifting unit 36 to lower the loading table 31, for example, by a predetermined number of sheets based on the detection result of the loading surface sensor, thereby keeping the loading surface of the medium M at a constant height.

The vibration driving unit 37 is, for example, an actuator such as a motor. The vibration driving unit 37 vibrates the end fence 32 and the top fence 33 based on the control of the control unit 38*a*.

The control unit 38*a* includes one or more processors (for example, a CPU) functioning as an arithmetic processing device that controls the operation of the entire medium loading device 30. The processor controls the operation of each unit of the loading table lifting unit 36, the vibration driving unit 37, and the like by reading and executing a predetermined program from, for example, the storage unit 38*b* or a storage medium (non-transitory computer-readable recording medium) detachable from the medium loading device 30. In this manner, the control unit 38*a* (or the medium loading device 30) functions as an example of a computer that executes a program. The control unit 38*a* may control a plurality of transport roller pairs 21 of the intermediate transport device 20.

The storage unit 38*b* includes, for example, a memory such as a ROM, which is a read-only semiconductor memory in which a predetermined control program is recorded in advance, and a RAM, which is a semiconductor memory that can be written and read at any time and is used as a working storage area as necessary when the processor executes various control programs.

The interface unit 38*c* transmits and receives various kinds of information to and from devices, such as the printing apparatus 10 and the intermediate transport device 20. For example, the interface unit 38*c* acquires the above-described medium information from the printing apparatus 10.

Here, the operation of the medium loading device 30 will be described in more detail with reference to FIGS. 3 to 5.

Figure 5:
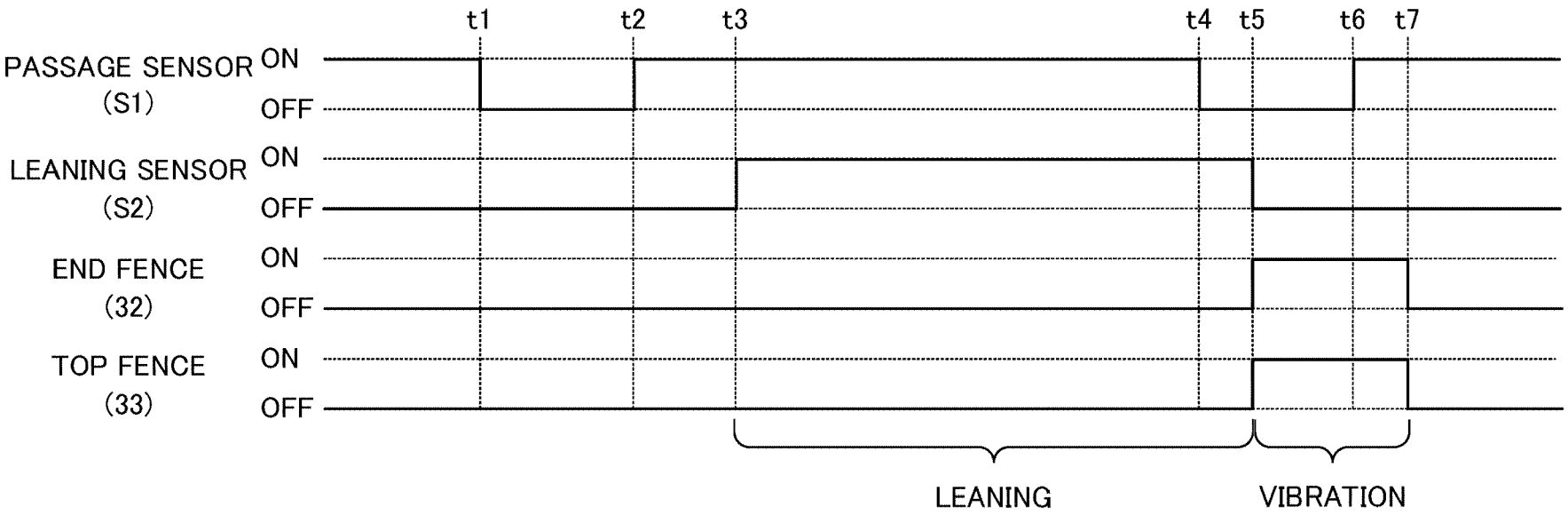
FIG. 5 is a diagram for explaining an operation of the medium loading device according to the embodiment.

As illustrated in FIG. 5, when the output signal of the passage sensor S1 passes through the rear end of the first medium M1 illustrated in FIG. 3, the output signal of the passage sensor S1 is switched from an ON signal (a state in which the medium M is detected) to an OFF signal (a state in which the medium M is not detected) (time t1).

Thereafter, when the output signal of the passage sensor S1 passes through the leading end of the second medium M2 shown in FIG. 4 after a time interval of, for example, 60 msec, the output signal of the passage sensor S1 is switched from the OFF signal to the ON signal (time t2).

As illustrated in FIG. 3, when the first medium M1 leans against the top fence 33, the leaning sensor S2 continuously outputs an ON signal (a state in which leaning is detected) (time t3 to time t5).

Then, for example, when the ON signal of the leaning sensor S2 is continuously output until the rear end of the second medium M2 illustrated in FIG. 4 passes through the passage sensor S1 (time t4), the control unit 38*a* vibrates the end fence 32 and the top fence 33 in the vibration direction D1 parallel to the transport direction A (time t5 to time t7). For example, the amplitude of the vibration of the end fence 32 and the top fence 33 is 4 mm (preferably, within 10 mm), and the vibration within 0.1 seconds (preferably, within 1 second) per one time is preferably continued 10 times or more. The vibration of the end fence 32 and the top fence 33 continues until after the leading end of the third medium M (not illustrated) passes through the passage sensor S1 (time t6).

As a result, as illustrated in FIG. 4, the leaning of the first medium M against the top fence 33 is eliminated (time t5 in FIG. 5). Here, even after the vibration of the end fence 32 and the top fence 33 has ended (time t7), when the leaning of the medium M is not eliminated (for example, if the leaning sensor S2 outputs an ON signal even when the rear end of the next (third) medium M has passed through the passage sensor S1), the control unit 38*a* may increase the amount of vibration of the end fence 32 and the top fence 33. For example, the amount of vibration may be increased by increasing the amplitude of vibration, increasing the vibration speed (increasing the vibration frequency), or increasing the vibration time. Alternatively, the control unit 38*a* may extend the specified vibration period (times t5 to t7) of the end fence 32 and the top fence 33, for example, until the leaning of the medium M is eliminated. Thereafter, in cases where the leaning of the medium M is not eliminated even if the plurality of media M passes through the passage sensor S1, it is preferable to issue an error notification to the user, stop the transport (printing) of the medium M, or the like.

In addition, increasing the amount of vibration of the end fence 32 and the top fence 33 is not limited to the case where the leaning of the medium M is not eliminated, and may be performed based on the medium information such as the size, direction, type, transport speed, and positional deviation on the upstream side in the transport direction A of the medium M described above. For example, the amount of vibration may be increased for the medium M whose leaning is difficult to eliminate due to the material of the medium M and the like. Alternatively, the control unit 38*a* may reduce the amount of vibration or determine whether or not to vibrate the end fence 32 and the top fence 33 based on the medium information.

In addition, the amount of vibration may be increased based on environmental information such as temperature detected by a temperature sensor and humidity detected by a humidity sensor. For example, in an environment of high temperature and high humidity, it is difficult to eliminate the leaning of the medium M. Accordingly, the amount of vibration may be increased. Alternatively, when area information can be acquired from the installation area or the like set in the medium loading device 30 (or the printing apparatus 10), the amount of vibration may be increased based on the environmental information assumed from the area information. For example, in an installation area with relatively high temperature and high humidity, the leaning of the medium M is less likely to be eliminated as compared with an installation area where the temperature and humidity are not relatively high. Therefore, the amount of vibration may be increased. Alternatively, the control unit 38*a* may reduce the amount of vibration or determine whether or not to vibrate the end fence 32 and the top fence 33 based on the environmental information.

In addition, in the example of FIG. 5, a period in which the end fence 32 vibrates and a period in which the top fence 33 vibrates are the same (time t5 to time t7). However, when one of the end fence 32 and the top fence 33 vibrates and then the other one vibrates, the medium M is more likely to be aligned and loaded than in a case where both vibrate simultaneously. Therefore, the disturbance of the loading state is less likely to occur. In addition, even if the period in which the end fence 32 vibrates and the period in which the top fence 33 vibrates partially overlap each other, the disturbance of the loading state is less likely to occur as compared with the case where the periods overlap each other as a whole.

Incidentally, FIG. 3 illustrates an example in which the first medium M1 leans against the top fence 33, but the medium M may also lean against the end fence 32. Since the leaning sensor S2 cannot determine which one of the end fence 32 and the top fence 33 the medium M leans against, even when the medium M leans against the end fence 32, the above-described operation in which both the end fence 32 and the top fence 33 vibrate is performed.

However, in a case where the leaning sensor S2 is a reflection sensor, a displacement sensor, a contact sensor, or the like, it is possible to determine to which of the end fence 32 and the top fence 33 the medium M is leaning. In this case, the control unit 38*a* may vibrate only the end fence 32 when the leaning of the medium M against the end fence 32 is detected, and may vibrate only the top fence 33 when the leaning of the medium M against the top fence 33 is detected. Alternatively, the control unit 38*a* may make the amount of vibration of the end fence 32 larger than the amount of vibration of the top fence 33 when the leaning of the medium M against the end fence 32 is detected, and may make the amount of vibration of the top fence 33 larger than the amount of vibration of the end fence 32 when the leaning of the medium M against the top fence 33 is detected.

In a configuration in which leaning of the medium M against the side fences 34 and 35 may occur, the control unit 38*a* may control the vibration driving unit 37 to vibrate the side fences 34 and 35. As described above, the regulation unit to vibrate is not limited to the end fence 32 and the top fence 33, and may be the side fences 34 and 35. As described above, the regulation unit to vibrate may be at least one of the end fence 32, the top fence 33, the side fence 34, and the side fence 35.

Figure 6:
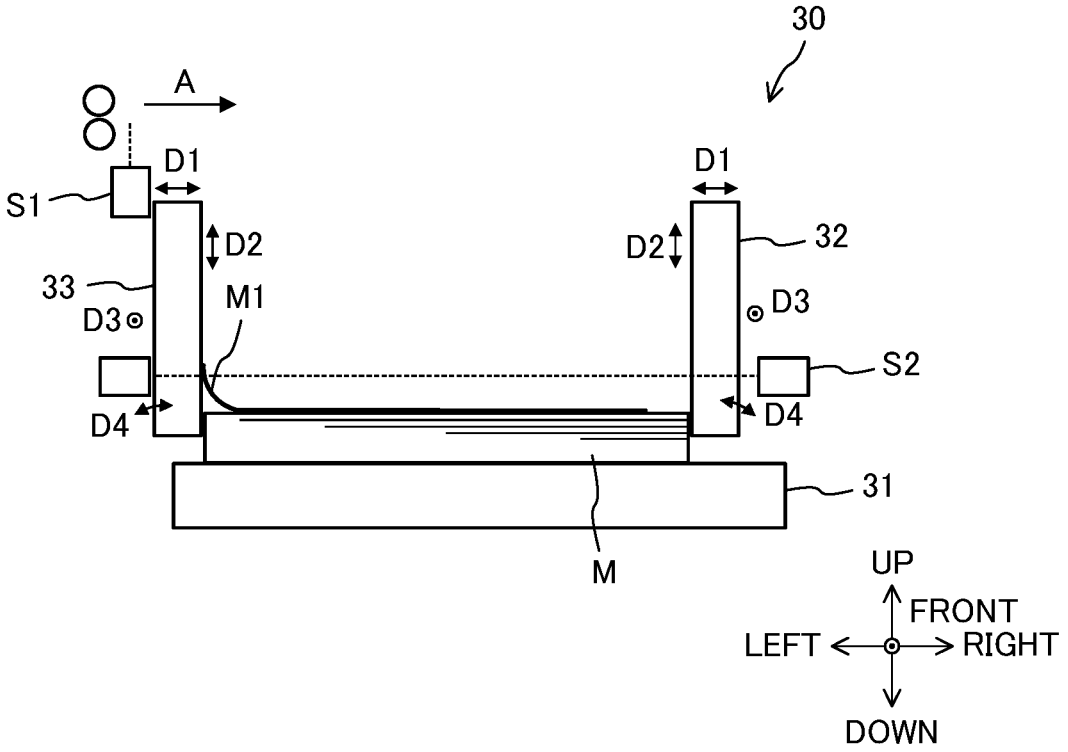
FIG. 6 is a diagram for explaining another vibration direction of the medium loading device according to the embodiment.

FIG. 6 is a diagram for explaining other vibration directions D2, D3, and D4 of the medium loading device 30.

FIG. 6 is the same as FIG. 3 except that the vibration directions D2, D3, and D4 are added. In the above description, the case where the vibration direction D1 of the end fence 32 and the top fence 33 is parallel to the transport direction A has been taken as an example. However, the end fence 32 and the top fence 33 (regulation unit) may vibrate in the vibration direction D2 parallel to the loading direction (up-down direction), vibrate in the vibration direction D3 parallel to the width direction (front-back direction) of the medium M perpendicular to the transport direction A, or vibrate in the vibration direction D4 that is a rotation direction (inclination direction).

When the end fence 32 and the top fence 33 (regulation unit) vibrate in the vibration direction D4 that is a rotation direction, the rotation center of the vibration may be, for example, parallel to the width direction (front-back direction) of the medium M.

In addition, the vibration directions D1, D2, D3, and D4 in which the regulation units such as the end fence 32 and the top fence 33 vibrate are preferably directions in which the regulation units can move. For example, since the end fence 32 moves in the vibration direction D1 (transport direction A) according to the size of the medium M or for the offset of the medium M, it is possible to avoid arranging a dedicated drive unit for vibration by using a drive unit for movement as the vibration driving unit 37. Therefore, it is possible to avoid an increase in cost, addition of components such as a motor, and complication of a structure.

In the present embodiment described above, the medium loading device 30 includes the loading table 31 on which the medium M is loaded, a regulation unit (for example, the end fence 32, the top fence 33, and the side fences 34 and 35) in contact with the end of the medium M loaded on the loading table 31, and the control unit 38*a* that vibrates the regulation unit when the leaning of the medium M against the regulation unit is detected.

Therefore, due to the vibration of the regulation unit, the medium M can be prevented from leaning against the regulation unit. In addition, as compared with an aspect in which the regulation unit moves by a predetermined distance so as to retract from the medium M, the leaning of the medium M can be eliminated in a short time by the vibration of the regulation unit. Therefore, it is possible to avoid the stop of the transport (printing) of the medium M due to the leaning of the medium M. Therefore, according to the present embodiment, it is possible to reduce the occurrence of downtime caused by the leaning of the medium M. In addition, since the leaning of the medium M can be eliminated in a short time, it is also possible to avoid the occurrence of disturbance of the loading state due to the loading of the subsequent medium M in a state in which the leaning of the medium M occurs. In addition, since the leaning of the medium M can be eliminated, it is possible to reduce the burden when the user manually eliminates the leaning and to improve the reliability of the medium loading device 30.

In addition, in the present embodiment, the regulation unit in contact with the end of the medium M loaded on the loading table 31 includes the end fence 32 (an example of the first regulation member) in contact with the end of the medium M on the downstream side in the transport direction A and the top fence 33 (second regulation member) in contact with the end of the medium M on the upstream side in the transport direction A, and the control unit 38*a* vibrates the end fence 32 and the top fence 33.

As described above, since both the end fence 32 and the top fence 33 can vibrate, the leaning of the medium M can be eliminated even if the medium M leans against either the end fence 32 or the top fence 33.

In addition, in the present embodiment, when the leaning of the medium M against the end fence 32 (an example of the first regulation member) is detected, the control unit 38*a* vibrates only the end fence 32 of the end fence 32 and the top fence 33 (an example of the second regulation member) or makes the amount of vibration of the end fence 32 larger than the amount of vibration of the top fence 33. In addition, when the leaning of the medium M against the top fence 33 is detected, the control unit 38*a* vibrates only the top fence 33 of the end fence 32 and the top fence 33 or makes the amount of vibration of the top fence 33 larger than the amount of vibration of the end fence 32. The control unit 38*a* can increase the amount of vibration by, for example, increasing the amplitude of vibration, increasing the vibration speed (increasing the vibration frequency), or increasing the vibration time.

Therefore, by vibrating only one of the end fence 32 and the top fence 33 on which the medium M leans, the control of vibrating the other one can be omitted. In addition, the leaning can be more reliably eliminated by increasing the amount of vibration of one of the end fence 32 and the top fence 33 on which the medium M leans. Therefore, it is possible to further reduce the occurrence of downtime caused by the leaning of the medium M.

In addition, in the present embodiment, the control unit 38*a* increases the amount of vibration of the regulation unit when the leaning of the medium M against the regulation unit is not eliminated after the vibration of the regulation unit.

This makes it possible to more reliably prevent the medium M from leaning against the regulation unit. Therefore, it is possible to further reduce the occurrence of downtime caused by the leaning of the medium M.

The present invention is not limited to the above-described embodiment as it is, and the components can be modified and embodied in a range without departing from the gist thereof at the implementation stage. In addition, various inventions can be formed by appropriately combining a plurality of components disclosed in the above-described embodiment. For example, all the components shown in the embodiment may be appropriately combined. It is a matter of course that various modifications or applications can be made in a range without departing from the gist of the invention. Hereinafter, inventions described in the claims as originally filed of the present application will be additionally described.

According to an aspect, a medium loading device includes a loading table on which a medium is loaded, a fence in contact with an end of the medium loaded on the loading table, and a processor configured to vibrate the fence when leaning of the medium against the fence is detected.

According to another aspect, the fence includes an end fence in contact with an end of the medium on a downstream side in a transport direction and a top fence in contact with an end of the medium on an upstream side in the transport direction, and the processor is configured to vibrate the end fence and the top fence.

According to another aspect, the processor is configured to vibrate only the end fence of the end fence and the top fence or to make an amount of vibration of the end fence larger than an amount of vibration of the top fence, when leaning of the medium against the end fence is detected, and the processor is configured to vibrate only the top fence of the end fence and the top fence or to make the amount of vibration of the top fence larger than the amount of vibration of the end fence, when leaning of the medium against the top fence is detected.

According to another aspect, the processor is configured to increase an amount of vibration of the fence when leaning of the medium against the fence is not eliminated after vibration of the fence.

What is claimed is:

1. A medium loading device, comprising:

a loading table on which a medium is loaded;

a fence in contact with an end of the medium loaded on the loading table;

a leaning sensor configured to detect a leaning of the medium against the fence; and a processor configured to vibrate the fence when a signal from the leaning sensor remains continuous, wherein the processor is further configured to increase an amount of vibration of the fence in a state in which the signal from the leaning sensor has not changed after vibration of the fence.

2. The medium loading device according to claim 1, wherein the fence includes an end fence in contact with an end of the medium on a downstream side in a transport direction and a top fence in contact with an end of the medium on an upstream side in the transport direction, and the processor is configured to vibrate the end fence and the top fence.

3. The medium loading device according to claim 2, wherein the processor is configured to vibrate only the end fence of the end fence and the top fence or to make an amount of vibration of the end fence larger than an amount of vibration of the top fence, in a state in which the signal from the leaning sensor has not changed after vibration of the end fence, and the processor is configured to vibrate only the top fence of the end fence and the top fence or to make the amount of vibration of the top fence larger than the amount of vibration of the end fence, in a state in which the signal from the leaning sensor has not changed after vibration of the top fence.

4. The medium loading device according to claim 1, wherein the increase in the amount of vibration includes at least one of an increase in an amplitude of vibration, an increase in a vibration speed, and an increase in a vibration time.

5. The medium loading device according to claim 1, wherein the processor is further configured to increase the amount of vibration in response to a determination of a temperature and a humidity from a temperature sensor and a humidity sensor.

6. The medium loading device according to claim 1, wherein the processor is further configured to vibrate the fence at an amplitude within 10 mm, and a vibration within 1 second per one time and continued 10 times or more.

* * * * *